US009399907B2

(12) United States Patent
Mo et al.

(10) Patent No.: US 9,399,907 B2
(45) Date of Patent: Jul. 26, 2016

(54) STEAM-INJECTING MINERAL INSULATED HEATER DESIGN

(71) Applicant: Shell Oil Company, Houston, TX (US)

(72) Inventors: Weijian Mo, Sugar Land, TX (US); Faruk Ömer Alpak, Houston, TX (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 14/546,773

(22) Filed: Nov. 18, 2014

(65) Prior Publication Data

US 2015/0136399 A1 May 21, 2015

Related U.S. Application Data

(60) Provisional application No. 61/906,725, filed on Nov. 20, 2013.

(51) Int. Cl.
*E21B 43/24* (2006.01)

(52) U.S. Cl.
CPC ..... *E21B 43/2401* (2013.01)

(58) Field of Classification Search
None
See application file for complete search history.

(56) References Cited

U.S. PATENT DOCUMENTS

| | | | | |
|---|---|---|---|---|
| 3,515,213 | A | 6/1970 | Prats | |
| 4,084,637 | A | 4/1978 | Todd | |
| 4,085,803 | A * | 4/1978 | Butler | 166/303 |
| 4,344,485 | A * | 8/1982 | Butler | 166/271 |
| 4,399,865 | A * | 8/1983 | Anderson et al. | 166/191 |
| 4,926,941 | A | 5/1990 | Glandt et al. | |
| 5,046,559 | A | 9/1991 | Glandt | |
| 5,060,726 | A | 10/1991 | Glandt | |
| 6,015,015 | A * | 1/2000 | Luft et al. | 166/384 |
| 6,257,334 | B1 * | 7/2001 | Cyr et al. | 166/272.7 |
| 7,073,578 | B2 | 7/2006 | Vinegar et al. | |
| 7,562,707 | B2 | 7/2009 | Miller | |
| 7,635,024 | B2 | 12/2009 | Karanikas et al. | |
| 7,673,681 | B2 | 3/2010 | Vinegar et al. | |
| 7,677,310 | B2 | 3/2010 | Vinegar et al. | |
| 7,677,314 | B2 | 3/2010 | Hsu | |
| 7,681,647 | B2 | 3/2010 | Mudunuri et al. | |
| 7,717,171 | B2 | 5/2010 | Stegemeier | |
| 7,730,947 | B2 | 6/2010 | Stegemeier et al. | |
| 7,798,220 | B2 | 9/2010 | Vinegar et al. | |
| 7,841,401 | B2 | 11/2010 | Kuhlman et al. | |
| 7,866,386 | B2 | 1/2011 | Beer et al. | |
| 8,200,072 | B2 | 6/2012 | Vinegar et al. | |
| 8,224,164 | B2 | 7/2012 | Sandberg et al. | |
| 8,238,730 | B2 | 8/2012 | Sandberg et al. | |
| 8,355,623 | B2 | 1/2013 | Vinegar et al. | |
| 2006/0175061 | A1 * | 8/2006 | Crichlow | 166/302 |
| 2006/0213657 | A1 * | 9/2006 | Berchenko et al. | 166/245 |

(Continued)

*Primary Examiner* — Angela M DiTrani
*Assistant Examiner* — Anuradha Ahuja

(57) ABSTRACT

Methods and systems for treating a subsurface hydrocarbon formation are described herein. A method for treating a subsurface hydrocarbon formation includes applying electrical current to a one or more heating elements positioned in a first tubular located in an opening in the subsurface hydrocarbon formation; providing fluid through a second tubular positioned in the first tubular in the subsurface hydrocarbon formation such that a portion of the fluid flows between the first tubular and second tubular and along a length of the tubulars; allowing the fluid to flow into a hydrocarbon layer in the subsurface hydrocarbon formation; and allowing heat to transfer from at least one of the heating elements and the fluid to a portion of the hydrocarbon layer in the subsurface hydrocarbon formation.

15 Claims, 8 Drawing Sheets

(56) References Cited

U.S. PATENT DOCUMENTS

| | | | | |
|---|---|---|---|---|
| 2007/0175638 | A1* | 8/2007 | Crichlow | 166/302 |
| 2008/0236809 | A1* | 10/2008 | Livingstone | 166/60 |
| 2009/0014180 | A1* | 1/2009 | Stegemeier et al. | 166/302 |
| 2009/0194280 | A1* | 8/2009 | Gil et al. | 166/267 |
| 2009/0260812 | A1 | 10/2009 | Reynolds et al. | |
| 2010/0258265 | A1* | 10/2010 | Karanikas et al. | 165/45 |
| 2011/0290503 | A1* | 12/2011 | Boone | 166/369 |
| 2012/0067580 | A1* | 3/2012 | Parsche | 166/302 |
| 2015/0034303 | A1* | 2/2015 | Parsche | 166/248 |
| 2015/0034304 | A1* | 2/2015 | Parsche | 166/248 |

* cited by examiner

STEAM-INJECTING MINERAL INSULATED HEATER DESIGN

RELATED PATENTS

This patent application incorporates by reference in its entirety each of U.S. Pat. No. 6,688,387 to Wellington et al.; U.S. Pat. No. 6,991,036 to Sumnu-Dindoruk et al.; U.S. Pat. No. 6,698,515 to Karanikas et al.; U.S. Pat. No. 6,880,633 to Wellington et al.; U.S. Pat. No. 6,782,947 to de Rouffignac et al.; U.S. Pat. No. 6,991,045 to Vinegar et al.; U.S. Pat. No. 7,073,578 to Vinegar et al.; U.S. Pat. No. 7,121,342 to Vinegar et al.; U.S. Pat. No. 7,320,364 to Fairbanks; U.S. Pat. No. 7,527,094 to McKinzie et al.; U.S. Pat. No. 7,584,789 to Mo et al.; U.S. Pat. No. 7,533,719 to Hinson et al.; U.S. Pat. No. 7,562,707 to Miller; U.S. Pat. No. 7,841,408 to Vinegar et al.; and U.S. Pat. No. 8,172,335 to Burns et al.; U.S. Patent Application Publication Nos. 2009-0189617 to Burns et al.; 2010/0258265 to Karanikas et al; 2011/0247806 to Harris; 2011/0247808 to Nguyen; 2011/0247820 to Marino et al.; 2011/0247814 to Karanikas et al.; 2012/0255730 to Daub et al.; and U.S. patent application Ser. No. 13/903,433 entitled "TREATING HYDROCARBON FORMATIONS USING HYBRID IN SITU HEAT TREATMENT AND STEAM METHODS" to CAO et al. filed Oct. 4, 2012.

BACKGROUND

1. Field of the Invention

The present invention relates generally to methods and systems for production of hydrocarbons and/or other products from various subsurface formations such as hydrocarbon containing formations.

2. Description of Related Art

Hydrocarbons obtained from subterranean formations are often used as energy resources, as feedstocks, and as consumer products. Concerns over depletion of available hydrocarbon resources and concerns over declining overall quality of produced hydrocarbons have led to development of processes for more efficient recovery, processing and/or use of available hydrocarbon resources. In situ processes may be used to remove hydrocarbon materials from subterranean formations that were previously inaccessible and/or too expensive to extract using available methods. Chemical and/or physical properties of hydrocarbon material in a subterranean formation may need to be changed to allow hydrocarbon material to be more easily removed from the subterranean formation and/or increase the value of the hydrocarbon material. The chemical and physical changes may include in situ reactions that produce removable fluids, composition changes, solubility changes, density changes, phase changes, and/or viscosity changes of the hydrocarbon material in the formation.

Large deposits of heavy hydrocarbons (heavy oil and/or tar) contained in relatively permeable formations (for example, in tar sands) are found in North America, South America, Africa, and Asia. Tar can be surface-mined and upgraded to lighter hydrocarbons such as crude oil, naphtha, kerosene, and/or gas oil. Surface milling processes may further separate the bitumen from sand. The separated bitumen may be converted to light hydrocarbons using conventional refinery methods. Mining and upgrading tar sand is usually substantially more expensive than producing lighter hydrocarbons from conventional oil reservoirs.

In situ production of hydrocarbons from tar sand may be accomplished by heating and/or injecting fluids into the formation. U.S. Pat. No. 4,084,637 to Todd; U.S. Pat. No. 4,926, 941 to Glandt et al.; U.S. Pat. No. 5,046,559 to Glandt, and U.S. Pat. No. 5,060,726 to Glandt, all of which are incorporated herein by reference, describe methods of producing viscous materials from subterranean formations that includes passing electrical current through the subterranean formation. Steam may be injected from the injector well into the formation to produce hydrocarbons.

Oil shale formations may be heated and/or retorted in situ to increase permeability in the formation and/or to convert the kerogen to hydrocarbons having an API gravity greater than 10°. In conventional processing of oil shale formations, portions of the oil shale formation containing kerogen are generally heated to temperatures above 370° C. to form low molecular weight hydrocarbons, carbon oxides, and/or molecular hydrogen. Some processes to produce bitumen from oil shale formations include heating the oil shale to a temperature above the natural temperature of the oil shale until some of the organic components of the oil shale are converted to bitumen and/or fluidizable material.

U.S. Pat. No. 3,515,213 to Prats, which is incorporated herein by reference, describes circulation of a fluid heated at a moderate temperature from one point within the formation to another for a relatively long period of time until a significant proportion of the organic components contained in the oil shale formation are converted to oil shale derived fluidizable materials.

U.S. Pat. No. 7,562,707 to Miller and U.S. Pat. No. 7,635,024 to Karanikas, all of which are incorporated herein by reference, describe methods and heaters for treating a hydrocarbon containing formation that includes providing heat from a plurality of heaters to mobilize hydrocarbons in the hydrocarbon formation.

U.S. Pat. No. 7,798,220 to Vinegar et al.; U.S. Pat. No. 7,717,171 to Stegemeier; U.S. Pat. No. 7,841,401 to Vinegar et al.; U.S. Pat. No. 7,739,947 to Stegemeier et al.; U.S. Pat. No. 7,681,647 to Mundunuri et al.; U.S. Pat. No. 7,677,314 to Hsu; U.S. Pat. No. 7,677,310 to Vinegar et al.; and U.S. Pat. No. 7,673,681 to Vinegar et al., all of which are incorporated herein by reference, describe methods for treating hydrocarbon formations that include heating hydrocarbons layers with heaters in combination with a drive and/or oxidizing fluid.

U.S. Pat. No. 7,073,578 to Vinegar et al., which is incorporated herein by reference describes a conduit placed inside an opening between a liner and a heater. The liner includes openings that allows fluid to flow through the liner. Steam may be provided to the conduit to inhibit coking along a length of the liner such that openings in the liner are not clogged and fluid flow through the openings is maintained.

U.S. Patent Publication No. 2009/0260812 to Reynolds et al., which is incorporated herein by reference, describes providing water through one or more wellbores to at least a portion of a hydrocarbon containing formation and combusting at least a portion of a fuel stream comprising hydrogen sulfide in the presence of an oxygen source in one or more heaters positioned in one of the wellbores to produce a combustion by-products stream. Heat from the combustion is transferred to a portion of the hydrocarbon containing formation. The combustion by-products stream includes one or more sulfur oxides. Heat of solution is released by contacting at least a portion of the combustion by-products stream with a portion of the water and/or a portion of water in the hydrocarbon containing formation.

As discussed above, there has been a significant amount of effort to produce hydrocarbons and/or bitumen from hydrocarbon containing formations. At present, however, there are still many hydrocarbon containing formations that cannot be economically produced. Thus, there is a need for improved methods for heating of a hydrocarbon containing formation that contains, for example, bitumen, and production of bitumen and/or liquid hydrocarbons having desired characteristics from the hydrocarbon containing formation are needed.

SUMMARY

Methods and systems for treating a subsurface hydrocarbon formation are described herein. In some embodiments, a method for treating a subsurface hydrocarbon formation includes applying electrical current to a one or more heating elements positioned in a first tubular located in an opening in the subsurface hydrocarbon formation, wherein the first tubular is positioned inside a second tubular; providing fluid through the second tubular positioned in the subsurface hydrocarbon formation such that a portion of the fluid flows between the first tubular and second tubular and along a length of the tubulars; allowing the fluid to flow into a hydrocarbon layer in the subsurface hydrocarbon formation; and allowing heat to transfer from at least one of the heating elements and the fluid to a portion of the hydrocarbon layer in the subsurface hydrocarbon formation.

In some embodiments, a method for treating a subsurface hydrocarbon formation includes applying electrical current to a one or more heaters positioned in an opening in a subsurface hydrocarbon formation, wherein the opening is uncased; providing heated fluid to the subsurface hydrocarbon formation through a tubular positioned in the opening in the subsurface hydrocarbon formation, wherein the tubular surrounds one or more of the heaters; and allowing heat to transfer from one or more of the heaters and at least a portion of the heated fluid to a portion of a hydrocarbon layer in the subsurface hydrocarbon formation such that a rate of heating the subsurface hydrocarbon formation is increased as compared to heating the subsurface hydrocarbon formation with using heat transfer from heaters in a plurality of heater wellbores and/or heated fluid injected through injection wellbores.

In some embodiments, a heating system for treating a subsurface hydrocarbon formation, includes a first tubular located in opening in the subsurface hydrocarbon formation, wherein the opening is uncased; one or more electrical heating elements, wherein at least a portion of the heating elements are positioned in the first tubular; and a second tubular, wherein at least a portion of the first tubular is positioned in the second tubular, and wherein the second tubular is configured to provide heated fluid to the subsurface hydrocarbon formation during use.

In further embodiments, features from specific embodiments may be combined with features from other embodiments. For example, features from one embodiment may be combined with features from any of the other embodiments.

In further embodiments, treating a subsurface formation is performed using any of the methods, systems, power supplies, or heaters described herein.

In further embodiments, additional features may be added to the specific embodiments described herein.

BRIEF DESCRIPTION OF THE DRAWINGS

Advantages of the present invention may become apparent to those skilled in the art with the benefit of the following detailed description and upon reference to the accompanying drawings in which.

Figure 1:
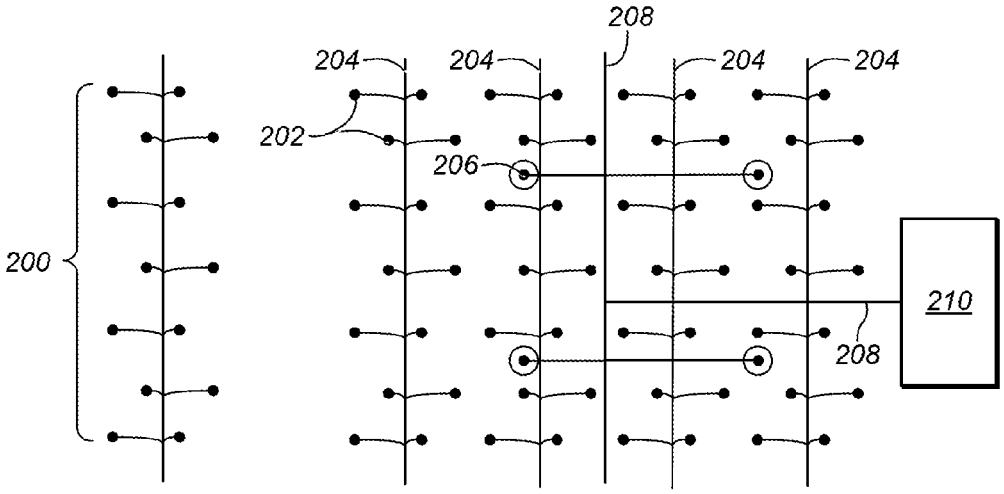
FIG. 1 depicts a schematic view of an embodiment of a portion of an in situ heat treatment system for treating a hydrocarbon containing formation.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

The following description generally relates to systems and methods for treating hydrocarbons in the formations. Such formations may be treated to yield hydrocarbon products, hydrogen, and other products.

"API gravity" refers to API gravity at 15.5° C. (60° F.). API gravity is as determined by ASTM Method D6822 or ASTM Method D1298.

"ASTM" refers to American Standard Testing and Materials.

In the context of reduced heat output heating systems, apparatus, and methods, the term "automatically" means such systems, apparatus, and methods function in a certain way without the use of external control (for example, external controllers such as a controller with a temperature sensor and a feedback loop, PID controller, or predictive controller).

"Asphalt/bitumen" refers to a semi-solid, viscous material soluble in carbon disulfide. Asphalt/bitumen may be obtained from refining operations or produced from subsurface formations.

"Carbon number" refers to the number of carbon atoms in a molecule. A hydrocarbon fluid may include various hydrocarbons with different carbon numbers. The hydrocarbon fluid may be described by a carbon number distribution. Carbon numbers and/or carbon number distributions may be determined by true boiling point distribution and/or gas-liquid chromatography.

"Condensable hydrocarbons" are hydrocarbons that condense at 25° C. and one atmosphere absolute pressure. Condensable hydrocarbons may include a mixture of hydrocarbons having carbon numbers greater than 4. "Non-condensable hydrocarbons" are hydrocarbons that do not condense at 25° C. and one atmosphere absolute pressure.

Non-condensable hydrocarbons may include hydrocarbons having carbon numbers less than 5.

"Coring" is a process that generally includes drilling a hole into a formation and removing a substantially solid mass of the formation from the hole.

"Cracking" refers to a process involving decomposition and molecular recombination of organic compounds to produce a greater number of molecules than were initially present. In cracking, a series of reactions take place accompanied by a transfer of hydrogen atoms between molecules. For example, naphtha may undergo a thermal cracking reaction to form ethene and $H_2$.

A "fluid" may be, but is not limited to, a gas, a liquid, an emulsion, a slurry, and/or a stream of solid particles that has flow characteristics similar to liquid flow.

"Fluid pressure" is a pressure generated by a fluid in a formation. "Lithostatic pressure" (sometimes referred to as "lithostatic stress") is a pressure in a formation equal to a weight per unit area of an overlying rock mass. "Hydrostatic pressure" is a pressure in a formation exerted by a column of water.

A "formation" includes one or more hydrocarbon containing layers, one or more non-hydrocarbon layers, an overburden, and/or an underburden. "Hydrocarbon layers" refer to layers in the formation that contain hydrocarbons. The hydrocarbon layers may contain non-hydrocarbon material and hydrocarbon material. The "overburden" and/or the "underburden" include one or more different types of impermeable materials. For example, the overburden and/or underburden may include rock, shale, mudstone, or wet/tight carbonate. In some embodiments of in situ hybrid treatment processes, the overburden and/or the underburden may include a hydrocarbon containing layer or hydrocarbon containing layers that are relatively impermeable and are not subjected to temperatures during in situ hybrid treatment processing that result in significant characteristic changes of the hydrocarbon containing layers of the overburden and/or the underburden. For example, the underburden may contain shale or mudstone, but the underburden is not allowed to heat to pyrolysis temperatures during the in situ hybrid treatment process. In some cases, the overburden and/or the underburden may be somewhat permeable.

"Formation fluids" refer to fluids present in a formation and may include pyrolyzation fluid, synthesis gas, mobilized hydrocarbons, and water (steam). Formation fluids may include hydrocarbon fluids as well as non-hydrocarbon fluids. The term "mobilized fluid" refers to fluids in a hydrocarbon containing formation that are able to flow as a result of thermal treatment of the formation. "Produced fluids" refer to fluids removed from the formation.

A "heat source" is any system for providing heat to at least a portion of a formation substantially by conductive and/or radiative heat transfer. For example, a heat source may include electrically conducting materials and/or electric heaters such as an insulated conductor, an elongated member, and/or a conductor disposed in a conduit. A heat source may also include a electrically conducting material and/or a heater that provides heat to a section proximate and/or surrounding a heating location such as a heater well.

A "heater" is any system or heat source for generating heat in a well or a near wellbore region. Heaters may be, but are not limited to, electric heaters.

"Heavy hydrocarbons" are viscous hydrocarbon fluids. Heavy hydrocarbons may include highly viscous hydrocarbon fluids such as heavy oil, tar, and/or asphalt. Heavy hydrocarbons may include carbon and hydrogen, as well as smaller concentrations of sulfur, oxygen, and nitrogen. Additional elements may also be present in heavy hydrocarbons in trace amounts. Heavy hydrocarbons may be classified by API gravity. Heavy hydrocarbons generally have an API gravity below about 20°. Heavy oil, for example, generally has an API gravity of about 10-20°, whereas tar generally has an API gravity below about 10°. The viscosity of heavy hydrocarbons is generally greater than about 100 centipoise at 15° C. Heavy hydrocarbons may include aromatics or other complex ring hydrocarbons.

Heavy hydrocarbons may be found in a relatively permeable formation. The relatively permeable formation may include heavy hydrocarbons entrained in, for example, sand or carbonate. "Relatively permeable" is defined, with respect to formations or portions thereof, as an average permeability of 10 millidarcy or more (for example, 10 or 100 millidarcy). "Relatively low permeability" is defined, with respect to formations or portions thereof, as an average permeability of less than about 10 millidarcy. One darcy is equal to about 0.99 square micrometers. An impermeable layer generally has a permeability of less than about 0.1 millidarcy.

Certain types of formations that include heavy hydrocarbons may also include, but are not limited to, natural mineral waxes, or natural asphaltites. "Natural mineral waxes" typically occur in substantially tubular veins that may be several meters wide, several kilometers long, and hundreds of meters deep. "Natural asphaltites" include solid hydrocarbons of an aromatic composition and typically occur in large veins. In situ recovery of hydrocarbons from formations such as natural mineral waxes and natural asphaltites may include melting to form liquid hydrocarbons and/or solution mining of hydrocarbons from the formations.

"Hydrocarbons" are generally defined as molecules formed primarily by carbon and hydrogen atoms. Hydrocarbons may also include other elements such as, but not limited to, halogens, metallic elements, nitrogen, oxygen, and/or sulfur. Hydrocarbons may be, but are not limited to, kerogen, bitumen, pyrobitumen, oils, natural mineral waxes, and asphaltites. Hydrocarbons may be located in or adjacent to mineral matrices in the earth. Matrices may include, but are not limited to, sedimentary rock, sands, silicilytes, carbonates, diatomites, and other porous media. "Hydrocarbon fluids" are fluids that include hydrocarbons. Hydrocarbon fluids may include, entrain, or be entrained in non-hydrocarbon fluids such as hydrogen, nitrogen, carbon monoxide, carbon dioxide, hydrogen sulfide, water, and ammonia.

An "in situ conversion process" refers to a process of heating a hydrocarbon containing formation from heat sources to raise the temperature of at least a portion of the formation above a pyrolysis temperature so that pyrolyzation fluid is produced in the formation.

An "in situ heat treatment process" refers to a process of heating a hydrocarbon containing formation with heat sources to raise the temperature of at least a portion of the formation above a temperature that results in mobilized fluid, visbreaking, and/or pyrolysis of hydrocarbon containing material so that mobilized fluids, visbroken fluids, and/or pyrolyzation fluids are produced in the formation.

An "in situ hybrid treatment process" refers to a process of injecting hot fluid in a formation while heating or simultaneously heating a hydrocarbon containing formation using an in situ heat treatment process to raise the temperature of at least a portion of the formation above a temperature that results in mobilized fluid, visbreaking, and/or pyrolysis of hydrocarbon containing material so that mobilized fluids, visbroken fluids, and/or pyrolyzation fluids are produced in the formation. An example of a hot fluid is water.

"Insulated conductor" refers to any elongated material that is able to conduct electricity and that is covered, in whole or in part, by an electrically insulating material.

"Karst" is a subsurface shaped by the dissolution of a soluble layer or layers of bedrock usually carbonate rock such as limestone or dolomite. The dissolution may be caused by meteoric or acidic water. The Grosmont formation in Alberta, Canada is an example of a karst (or "karsted") carbonate formation.

"Kerogen" is a solid, insoluble hydrocarbon that has been converted by natural degradation and that principally contains carbon, hydrogen, nitrogen, oxygen, and sulfur. Coal and oil shale are typical examples of materials that contain kerogen. "Bitumen" is a non-crystalline solid or viscous hydrocarbon material that is substantially soluble in carbon disulfide. "Oil" is a fluid containing a mixture of condensable hydrocarbons.

"Perforations" include openings, slits, apertures, or holes in a wall of a conduit, tubular, pipe or other flow pathway that allow flow into or out of the conduit, tubular, pipe or other flow pathway.

Pyrolysis" is the breaking of chemical bonds due to the application of heat. For example, pyrolysis may include transforming a compound into one or more other substances by heat alone. Heat may be transferred to a section of the formation to cause pyrolysis.

"Pyrolyzation fluids" or "pyrolysis products" refers to fluid produced substantially during pyrolysis of hydrocarbons. Fluid produced by pyrolysis reactions may mix with other fluids in a formation. The mixture would be considered pyrolyzation fluid or pyrolyzation product. As used herein, "pyrolysis section" refers to a volume of a formation (for example, a relatively permeable formation such as a tar sands formation) that is reacted or reacting to form a pyrolyzation fluid.

"Rich layers" in a hydrocarbon containing formation are relatively thin layers (typically about 0.2 m to about 0.5 m thick). Rich layers generally have a richness of about 0.150 L/kg or greater. Some rich layers have a richness of about 0.170 L/kg or greater, of about 0.190 L/kg or greater, or of about 0.210 L/kg or greater. Lean layers of the formation have a richness of about 0.100 L/kg or less and are generally thicker than rich layers. The richness and locations of layers are determined, for example, by coring and subsequent Fischer assay of the core, density or neutron logging, or other logging methods. Rich layers may have a lower initial thermal conductivity than other layers of the formation. Typically, rich layers have a thermal conductivity 1.5 times to 3 times lower than the thermal conductivity of lean layers. In addition, rich layers have a higher thermal expansion coefficient than lean layers of the formation.

"Subsidence" is a downward movement of a portion of a formation relative to an initial elevation of the surface.

"Superposition of heat" refers to providing heat from two or more heat sources to a selected section of a formation such that the temperature of the formation at least at one location between the heat sources is influenced by the heat sources.

"Synthesis gas" is a mixture including hydrogen and carbon monoxide. Additional components of synthesis gas may include water, carbon dioxide, nitrogen, methane, and other gases. Synthesis gas may be generated by a variety of processes and feedstocks. Synthesis gas may be used for synthesizing a wide range of compounds.

"Tar" is a viscous hydrocarbon that generally has a viscosity greater than about 10,000 centipoise at 15° C. The specific gravity of tar generally is greater than 1.000. Tar may have an API gravity less than 10°.

A "tar sands formation" is a formation in which hydrocarbons are predominantly present in the form of heavy hydrocarbons and/or tar entrained in a mineral grain framework or other host lithology (for example, sand or carbonate). Examples of tar sands formations include formations such as the Athabasca formation, the Grosmont formation, and the Peace River formation, all three in Alberta, Canada; and the Faja formation in the Orinoco belt in Venezuela.

"Temperature limited heater" generally refers to a heater that regulates heat output (for example, reduces heat output) above a specified temperature without the use of external controls such as temperature controllers, power regulators, rectifiers, or other devices. Temperature limited heaters may be AC (alternating current) or modulated (for example, "chopped") DC (direct current) powered electrical resistance heaters.

"Thermal fracture" refers to fractures created in a formation caused by expansion or contraction of a formation and/or fluids in the formation, which is in turn caused by increasing/decreasing the temperature of the formation and/or fluids in the formation, and/or by increasing/decreasing a pressure of fluids in the formation due to heating.

"Thickness" of a layer refers to the thickness of a cross section of the layer, wherein the cross section is normal to a face of the layer.

"Time-varying current" refers to electrical current that produces skin effect electricity flow in a ferromagnetic conductor and has a magnitude that varies with time. Time-varying current includes both alternating current (AC) and modulated direct current (DC).

A "u-shaped wellbore" refers to a wellbore that extends from a first opening in the formation, through at least a portion of the formation, and out through a second opening in the formation. In this context, the wellbore may be only roughly in the shape of a "v" or "u", with the understanding that the "legs" of the "u" do not need to be parallel to each other, or perpendicular to the "bottom" of the "u" for the wellbore to be considered "u-shaped".

"Upgrade" refers to increasing the quality of hydrocarbons. For example, upgrading heavy hydrocarbons may result in an increase in the API gravity of the heavy hydrocarbons.

"Visbreaking" refers to the untangling of molecules in fluid during heat treatment and/or to the breaking of large molecules into smaller molecules during heat treatment, which results in a reduction of the viscosity of the fluid.

"Viscosity" refers to kinematic viscosity at 40° C. unless otherwise specified. Viscosity is as determined by ASTM Method D445.

A "vug" is a cavity, void or large pore in a rock that is commonly lined with mineral precipitates.

"Wax" refers to a low melting organic mixture, or a compound of high molecular weight that is a solid at lower temperatures and a liquid at higher temperatures, and when in solid form can form a barrier to water. Examples of waxes include animal waxes, vegetable waxes, mineral waxes, petroleum waxes, and synthetic waxes.

The term "wellbore" refers to a hole in a formation made by drilling or insertion of a conduit into the formation. A wellbore may have a substantially circular cross section, or another cross-sectional shape. As used herein, the terms "well" and "opening," when referring to an opening in the formation may be used interchangeably with the term "wellbore."

A formation may be treated in various ways to produce many different products. Different stages or processes may be used to treat the formation during an in situ heat treatment process. In some embodiments, one or more sections of the formation are solution mined to remove soluble minerals from the sections. Solution mining minerals may be performed before, during, and/or after the in situ heat treatment process. In some embodiments, the average temperature of one or more sections being solution mined may be maintained below about 120° C.

In some embodiments, one or more sections of the formation are heated to remove water from the sections and/or to remove methane and other volatile hydrocarbons from the sections. In some embodiments, the average temperature may be raised from ambient temperature to temperatures below about 220° C. during removal of water and volatile hydrocarbons.

In some embodiments, one or more sections of the formation are heated to temperatures that allow for movement and/or visbreaking of hydrocarbons in the formation. In some embodiments, the average temperature of one or more sections of the formation are raised to mobilization temperatures of hydrocarbons in the sections (for example, to temperatures ranging from 100° C. to 250° C., from 120° C. to 240° C., or from 150° C. to 230° C.).

In some embodiments, one or more sections are heated to temperatures that allow for pyrolysis reactions in the formation. In some embodiments, the average temperature of one or more sections of the formation may be raised to pyrolysis temperatures of hydrocarbons in the sections (for example, temperatures ranging from 230° C. to 900° C., from 240° C. to 400° C. or from about 250° C. to 350° C.).

Heating the hydrocarbon containing formation with a plurality of heat sources may establish thermal gradients around the heat sources that raise the temperature of hydrocarbons in the formation to desired temperatures at desired heating rates. The rate of temperature increase through the mobilization temperature range and/or the pyrolysis temperature range for desired products may affect the quality and quantity of the formation fluids produced from the hydrocarbon containing formation. Slowly raising the temperature of the formation through the mobilization temperature range and/or pyrolysis temperature range may allow for the production of high quality, high API gravity hydrocarbons from the formation. Slowly raising the temperature of the formation through the mobilization temperature range and/or pyrolysis temperature range may allow for the removal of a large amount of the hydrocarbons present in the formation as hydrocarbon product.

In some in situ heat treatment embodiments, a portion of the formation is heated to a desired temperature instead of slowly raising the temperature through a temperature range. In some embodiments, the desired temperature is 300° C., 325° C., or 350° C. Other temperatures may be selected as the desired temperature.

Superposition of heat from heat sources allows the desired temperature to be relatively quickly and efficiently established in the formation. Energy input into the formation from the heat sources may be adjusted to maintain the temperature in the formation substantially at a desired temperature.

Mobilization and/or pyrolysis products may be produced from the formation through production wells. In some embodiments, the average temperature of one or more sections is raised to mobilization temperatures and hydrocarbons are produced from the production wells. The average temperature of one or more of the sections may be raised to pyrolysis temperatures after production due to mobilization decreases below a selected value. In some embodiments, the average temperature of one or more sections may be raised to pyrolysis temperatures without significant production before reaching pyrolysis temperatures. Formation fluids including pyrolysis products may be produced through the production wells.

In some embodiments, the average temperature of one or more sections may be raised to temperatures sufficient to allow synthesis gas production after mobilization and/or pyrolysis. In some embodiments, hydrocarbons may be raised to temperatures sufficient to allow synthesis gas production without significant production before reaching the temperatures sufficient to allow synthesis gas production. For example, synthesis gas may be produced in a temperature range from about 400° C. to about 1200° C., about 500° C. to about 1100° C., or about 550° C. to about 1000° C. A synthesis gas generating fluid (for example, steam and/or water) may be introduced into the sections to generate synthesis gas. Synthesis gas may be produced from production wells.

Solution mining, removal of volatile hydrocarbons and water, mobilizing hydrocarbons, pyrolyzing hydrocarbons, generating synthesis gas, and/or other processes may be performed during the in situ heat treatment process. In some embodiments, some processes may be performed after the in situ heat treatment process. Such processes may include, but are not limited to, recovering heat from treated sections, storing fluids (for example, water and/or hydrocarbons) in previously treated sections, and/or sequestering carbon dioxide in previously treated sections.

FIG. 1 depicts a schematic view of an embodiment of a portion of the in situ heat treatment system for treating the hydrocarbon containing formation. The in situ heat treatment system may include barrier wells 200. Barrier wells are used to form a barrier around a treatment area. The barrier inhibits fluid flow into and/or out of the treatment area. Barrier wells include, but are not limited to, dewatering wells, vacuum wells, capture wells, injection wells, grout wells, freeze wells, or combinations thereof. In some embodiments, barrier wells 200 are dewatering wells. Dewatering wells may remove liquid water and/or inhibit liquid water from entering a portion of the formation to be heated, or to the formation being heated. In the embodiment depicted in FIG. 1, the barrier wells 200 are shown extending only along one side of heat sources 202, but the barrier wells typically encircle all heat sources 202 used, or to be used, to heat a treatment area of the formation.

Heat sources 202 are placed in at least a portion of the formation. Heat sources 202 may include heaters such as insulated conductors, and/or conductor-in-conduit heaters. Heat sources 202 provide heat to at least a portion of the formation to heat hydrocarbons in the formation. Energy may be supplied to heat sources 202 through supply lines 204. Supply lines 204 may be structurally different depending on the type of heat source or heat sources used to heat the formation. Supply lines 204 for heat sources may transmit electricity for electric heaters. In some embodiments, electricity for an in situ heat treatment process may be provided by a nuclear power plant or nuclear power plants. The use of nuclear power may allow for reduction or elimination of carbon dioxide emissions from the in situ heat treatment process.

When the formation is heated, the heat input into the formation may cause expansion of the formation and geomechanical motion. The heat sources may be turned on before, at the same time, or during a dewatering process. Computer simulations may model formation response to heating. The computer simulations may be used to develop a pattern and time sequence for activating heat sources in the formation so that geomechanical motion of the formation does not adversely affect the functionality of heat sources, production wells, and other equipment in the formation.

Heating the formation may cause an increase in permeability and/or porosity of the formation. Increases in permeability and/or porosity may result from a reduction of mass in the formation due to vaporization and removal of water, removal of hydrocarbons, and/or creation of fractures. Fluid may flow more easily in the heated portion of the formation because of the increased permeability and/or porosity of the formation. Fluid in the heated portion of the formation may move a considerable distance through the formation because of the increased permeability and/or porosity. The considerable distance may be over 1000 m depending on various factors, such as permeability of the formation, properties of the fluid, temperature of the formation, and pressure gradient allowing movement of the fluid. The ability of fluid to travel considerable distance in the formation allows production wells 206 to be spaced relatively far apart in the formation.

Production wells 206 are used to remove formation fluid from the formation. In some embodiments, production well 206 includes a heat source. The heat source in the production well may heat one or more portions of the formation at or near the production well. In some in situ heat treatment process embodiments, the amount of heat supplied to the formation from the production well per meter of the production well is less than the amount of heat applied to the formation from a heat source that heats the formation per meter of the heat source. Heat applied to the formation from the production well may increase formation permeability adjacent to the production well by vaporizing and removing liquid phase fluid adjacent to the production well and/or by increasing the permeability of the formation adjacent to the production well by formation of macro and/or micro fractures.

More than one heat source may be positioned in the production well. A heat source in a lower portion of the production well may be turned off when superposition of heat from adjacent heat sources heats the formation sufficiently to counteract benefits provided by heating the formation with the production well. In some embodiments, the heat source in an upper portion of the production well may remain on after the heat source in the lower portion of the production well is deactivated. The heat source in the upper portion of the well may inhibit condensation and reflux of formation fluid.

In some embodiments, the heat source in production well 206 allows for vapor phase removal of formation fluids from the formation. Providing heating at or through the production well may: (1) inhibit condensation and/or refluxing of production fluid when such production fluid is moving in the production well proximate the overburden, (2) increase heat input into the formation, (3) increase production rate from the production well as compared to a production well without a heat source, (4) inhibit condensation of high carbon number compounds ($C_6$ hydrocarbons and above) in the production well, and/or (5) increase formation permeability at or proximate the production well.

Subsurface pressure in the formation may correspond to the fluid pressure generated in the formation. As temperatures in the heated portion of the formation increase, the pressure in the heated portion may increase as a result of thermal expansion of in situ fluids, increased fluid generation and vaporization of water. Controlling rate of fluid removal from the formation may allow for control of pressure in the formation. Pressure in the formation may be determined at a number of different locations, such as near or at production wells, near or at heat sources, or at monitor wells.

In some hydrocarbon containing formations, production of hydrocarbons from the formation is inhibited until at least some hydrocarbons in the formation have been mobilized and/or pyrolyzed. Formation fluid may be produced from the formation when the formation fluid is of a selected quality. In some embodiments, the selected quality includes an API gravity of at least about 20°, 30°, or 40°. Inhibiting production until at least some hydrocarbons are mobilized and/or pyrolyzed may increase conversion of heavy hydrocarbons to light hydrocarbons. Inhibiting initial production may minimize the production of heavy hydrocarbons from the formation. Production of substantial amounts of heavy hydrocarbons may require expensive equipment and/or reduce the life of production equipment.

In some hydrocarbon containing formations, hydrocarbons in the formation may be heated to mobilization and/or pyrolysis temperatures before substantial permeability has been generated in the heated portion of the formation. An initial lack of permeability may inhibit the transport of generated fluids to production wells 206. During initial heating, fluid pressure in the formation may increase proximate heat sources 202. The increased fluid pressure may be released, monitored, altered, and/or controlled through one or more heat sources 202. For example, selected heat sources 202 or separate pressure relief wells may include pressure relief valves that allow for removal of some fluid from the formation.

In some embodiments, pressure generated by expansion of mobilized fluids, pyrolysis fluids or other fluids generated in the formation may be allowed to increase because an open path to production wells 206 or any other pressure sink may not yet exist in the formation. The fluid pressure may be allowed to increase towards a lithostatic pressure. Fractures in the hydrocarbon containing formation may form when the fluid approaches minimal in situ stress. In some embodiments, the minimal in situ stress may equal to or approximate the lithostatic pressure of the hydrocarbon formation. For example, fractures may form from heat sources 202 to production wells 206 in the heated portion of the formation. The generation of fractures in the heated portion may relieve some of the pressure in the portion. Pressure in the formation may have to be maintained below a selected pressure to inhibit unwanted production, fracturing of the overburden or underburden, and/or coking of hydrocarbons in the formation.

After mobilization and/or pyrolysis temperatures are reached and production from the formation is allowed, pressure in the formation may be varied to alter and/or control a composition of produced formation fluid, to control a percentage of condensable fluid as compared to non-condensable fluid in the formation fluid, and/or to control an API gravity of formation fluid being produced. For example, decreasing pressure may result in production of a larger condensable fluid component. The condensable fluid component may contain a larger percentage of olefins.

In some in situ heat treatment process embodiments, pressure in the formation may be maintained high enough to promote production of formation fluid with an API gravity of greater than 20°. Maintaining increased pressure in the formation may inhibit formation subsidence during in situ heat treatment. Maintaining increased pressure may reduce or eliminate the need to compress formation fluids at the surface to transport the fluids in collection conduits to treatment facilities.

Maintaining increased pressure in a heated portion of the formation may surprisingly allow for production of large quantities of hydrocarbons of increased quality and of relatively low molecular weight. Pressure may be maintained so that formation fluid produced has a minimal amount of compounds above a selected carbon number. The selected carbon number may be at most 25, at most 20, at most 12, or at most 8. Some high carbon number compounds may be entrained in vapor in the formation and may be removed from the formation with the vapor. Maintaining increased pressure in the formation may inhibit entrainment of high carbon number compounds and/or multi-ring hydrocarbon compounds in the vapor. High carbon number compounds and/or multi-ring hydrocarbon compounds may remain in a liquid phase in the formation for significant time periods. The significant time periods may provide sufficient time for the compounds to pyrolyze to form lower carbon number compounds.

Generation of relatively low molecular weight hydrocarbons is believed to be due, in part, to autogenous generation and reaction of hydrogen in a portion of the hydrocarbon containing formation. For example, maintaining an increased pressure may force hydrogen generated during pyrolysis into the liquid phase within the formation. Heating the portion to a temperature in a pyrolysis temperature range may pyrolyze hydrocarbons in the formation to generate liquid phase pyrolyzation fluids. The generated liquid phase pyrolyzation fluids components may include double bonds and/or radicals. Hydrogen ($H_2$) in the liquid phase may reduce double bonds of the generated pyrolyzation fluids, thereby reducing a potential for polymerization or formation of long chain compounds from the generated pyrolyzation fluids. In addition, $H_2$ may also neutralize radicals in the generated pyrolyzation fluids. $H_2$ in the liquid phase may inhibit the generated pyrolyzation fluids from reacting with each other and/or with other compounds in the formation.

Formation fluid produced from production wells 206 may be transported through collection piping 208 to treatment facilities 210. Formation fluids may also be produced from heat sources 202. For example, fluid may be produced from heat sources 202 to control pressure in the formation adjacent to the heat sources. Fluid produced from heat sources 202 may be transported through tubing or piping to collection piping 208 or the produced fluid may be transported through tubing or piping directly to treatment facilities 210. Treatment facilities 210 may include separation units, reaction units, upgrading units, fuel cells, turbines, storage vessels, and/or other systems and units for processing produced formation fluids. The treatment facilities may form transportation fuel from at least a portion of the hydrocarbons produced from the formation. In some embodiments, the transportation fuel may be jet fuel, such as JP-8.

Hydrocarbon containing formations (for example, oil shale formations and/or tar sands formations) may contain significant amounts of bitumen entrained in the mineral matrix of the formation and/or significant amounts of bitumen in shallow layers of the formation. Heating hydrocarbon formations containing entrained bitumen to high temperatures may produce non-condensable hydrocarbons and non-hydrocarbon gases instead of liquid hydrocarbons and/or bitumen. Heating shallow formation layers containing bitumen may also result in a significant amount of gaseous products produced from the formation. Methods and/or systems of heating hydrocarbon formations having entrained bitumen at lower temperatures that convert portions of the formation to bitumen and/or lower molecular weight hydrocarbons, and/or increases permeability in the hydrocarbon containing formation to produce liquid hydrocarbons and/or bitumen are desired.

A hydrocarbon formation may be treated using a steam injection process. The steam injection process, however, may not treat the formation uniformly. For example, steam injection may not be uniform throughout the formation. Variations in the properties of the formation (for example, fluid injectivities, permeabilities, and/or porosities) may result in non-uniform injection of the steam through the formation. Because of the non-uniform injection of the steam, the steam may remove hydrocarbons from different portions of the formation at different rates or with different results. For example, some portions of the formation may have little or no steam injectivity, which inhibits the hydrocarbon production from these portions. After the steam injection process is completed, the formation may have portions that have lower amounts of hydrocarbons produced (more hydrocarbons remaining) than other parts of the formation. Although steam injection can put a lot of energy into the reservoir in a short time, steam injection cannot reach pyrolysis temperatures greater than 270° C.

Certain types of formations have low initial matrix permeabilities and contain formation fluid having high initial viscosities at initial or ambient condition that inhibit these formations from being easily treated using conventional steam drive processes such as SAGD (steam-assisted gravity drainage) or CSS (cyclic steam stimulation). For example, carbonate formations (such as the Grosmont reservoir in Alberta, Canada) have low matrix permeabilities and contain formation fluid with high viscosities that make these formations unsuitable for conventional steam drive processes. Carbonate formations may also be highly heterogeneous (for example, have highly different vertical and horizontal permeabilities), which makes it difficult to control flow of fluids (such as steam) through the formation. In addition, some carbonate formations are relatively shallow formations with low overburden fracture pressures that inhibit the use of high pressure steam injection because of the need to avoid breaking or fracturing the overburden.

Typically, these initial permeabilities and initial viscosities are not favorable for steam injection into the hydrocarbon layers because the steam injection pressure needed to get steam to move hydrocarbons through the formation is above the fracture pressure of overburden of the formation. Staying below the overburden fracture pressure may be especially difficult for shallower formations (for example, the Grosmont reservoir) because the overburden fracture pressure is relatively small in such shallow formations. Heaters have been used to provide heat to hydrocarbon layers to increases the steam injectivity in the layer. Heat from the heaters may reduce the viscosity of formation fluid in the portion surrounding the heater such that steam injected into the layer at pressures below the overburden fracture pressure can move hydrocarbons in the layer. The use of heaters prior to, or after, steam injection, however, may be economically undesirable.

In some embodiments, hydrocarbon formations include pre-existing openings and/or fractures (for example, highly fractured carbonate formations, highly permeable layers (for example, greater than 1 Darcy) that heated fluid (for example, water) may be injected, or the like). The fractures may form interconnecting pathways (horizontal, vertical, and inclined pathways) in the formation. In some embodiments, the fractures are substantially horizontal or inclined in the formation and are separated by hydrocarbon layers. One or more fractures may be substantially vertical in the formation and be separated by hydrocarbon layers. In some embodiments, vertical fractures intersect horizontal fractures. In some embodiments, one or more wellbores are connected to one or more fractures in the formation.

In some embodiments, tight vugs may be vugs filled with viscous fluids such as bitumen or heavy oil. In some embodiments, the vugs have a porosity of at least about 20 porosity units, at least about 30 porosity units, or at least about 35 porosity units. The formation may have a porosity of at most about 15 porosity units, at most about 10 porosity units, or at most about 5 porosity units. The tight vugs inhibit steam or other fluids from being injected into the formation or the layers with tight vugs. Injection of fluid through vertical fractures and/or horizontal fractures may permeate or heat vugs sufficiently to decrease the viscosity of the fluids in the tight vugs and allow the fluids to drain (for example, mobilize the fluids). The mobilized fluids may be produced from the formation.

In certain embodiments, the initial vertical matrix permeability in hydrocarbon layers is at most about 300 millidarcy and the initial horizontal matrix permeability is at most about 1 darcy. In some carbonate formations, the initial vertical matrix permeability is less than the initial horizontal matrix permeability such as, for example, in the Grosmont reservoir in Alberta, Canada. The initial vertical and initial horizontal matrix permeabilities may vary depending on the location in the formation and/or the type of formation.

In some embodiments, the formation is fractured sufficiently that using a fluid injection heater that provides hot fluid (for example, steam) into the fractures may provide improved heat distribution to the formation and/or increase the amount of heat provided to the formation as compared to other conventional methods. For example the fracture dimension may range from 1 m to 30 m, from 5 m to 25 m, or from 10 m to 20 m. In some embodiments, a fracture spacing is 20 meters. The heated fluid may be injected in fractures to mobilize fluid from the fractures.

In some embodiment, a fluid (for example, steam and/or hot water) injection heater may be used as a heat source to heat at least a portion of a hydrocarbon layer. The fluid injection heater may include one or more heating elements or heat sources positioned in a tubular. The tubular may be inside another tubular (for example, a canister). The heating element or heat source may be an insulated conductor.

The insulated conductor may include an inner electrical conductor (core) surrounded by an electrical insulator and an outer electrical conductor (jacket). The electrical insulator may include mineral insulation (for example, magnesium oxide) or other electrical insulation.

In some embodiments, the canister may include an end member (for example, a cover or cap) positioned in the canister (second tubular). The end member may be positioned in the canister such that the end member changes the direction of the flow of the fluid through the canister. For example, the end member may be positioned at the end of the canister and flow of steam is reversed upon contact with the end member.

In some embodiments, the canister may include perforations to allow fluid and/or heated fluid to flow into the formation. Perforations in the canister may assist in regulating the amount of pressure along the length of the heater such that there is little to no pressure drop along the length of the heater.

The fluid injection heater may be placed in an opening in a hydrocarbon containing formation. In some embodiments, the fluid injection heater is placed in an uncased opening in the hydrocarbon containing formation. Placing the fluid injection heater in an uncased opening in the hydrocarbon containing formation may allow heat to transfer from the fluid to the formation by convection. Heat may transfer from insulated conductor to the formation and/or the fluid by radiation as well as conduction.

A fluid injection heater may allow steam to be directly injected into a wellbore that is positioned near or connects to a fracture in the hydrocarbon layer. Since the rock formation is naturally fractured, the steam escapes into the formation. In conventional heat processes that use steam and/or heater heating, the highly mobile steam takes the least-resistant path through the fractures and does not flow along the path of the heater. Thus, hot-spot formation in the heater element is difficult to control or eliminate. Furthermore, steam conformance may be uneven, and, thus the formation heating may be ineffective. The use of a fluid injection heater controls the flow of the steam into the fractures and along the length of the heater. Thus, steam conformance is more even, hot spots are controlled and/or substantially eliminated, and the formation is heated more effectively.

Figure 2:
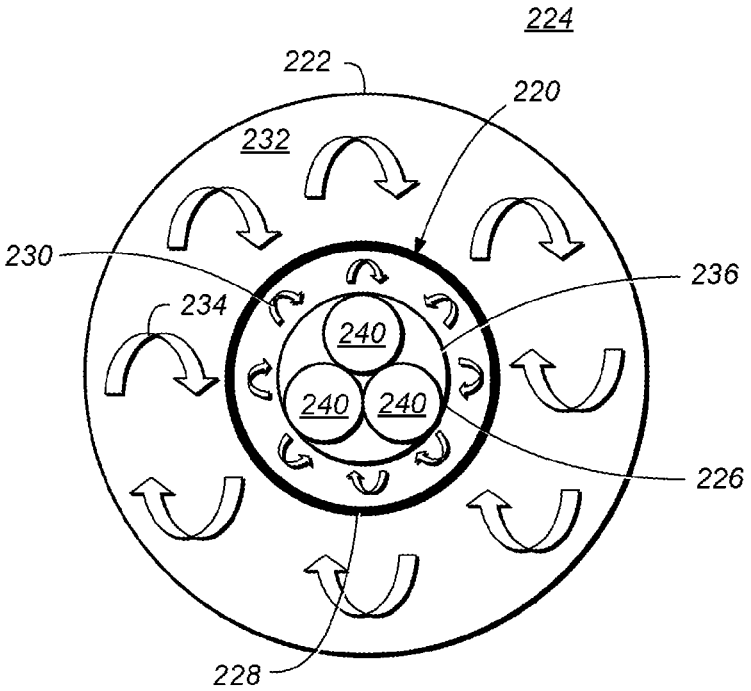
FIG. 2 depicts a perspective view of an end portion of an embodiment of a fluid injection heater in a wellbore in a hydrocarbon layer.

FIG. 2 depicts a perspective view of an end portion of an embodiment of fluid injection heater 220 in wellbore 222 in hydrocarbon layer 224. Wellbore 222 is uncased. Fluid injection heater 220 includes heater 226 positioned or partially positioned inside of tubular 228 (canister). Canister 228 may be open at the end to allow steam (shown by arrows 230) to be injected between the outside portion of heating element 226 and the inside wall of the canister and into wellbore opening 232 as shown by arrows 234.

Canister 228 is made of material resistant to water corrosion and has sufficient strength to deliver high pressure steam. For example, canister 228 is made of material of sufficient strength and construction to deliver steam to the hydrocarbon formation at a rate of 1 to 2 barrels per day for 400 feet or a 2.42 m/s injection velocity. In some embodiments, canister 228 is made of carbons steels such as K55, L80, and P110/C110. In some embodiments, heater 226 is coupled to canister 228. For example, one or more centralizers with openings that allow fluid to flow around the heater may maintain a separation distance between the inner wall of canister 228 and the jacket of heater 226.

Figure 3:
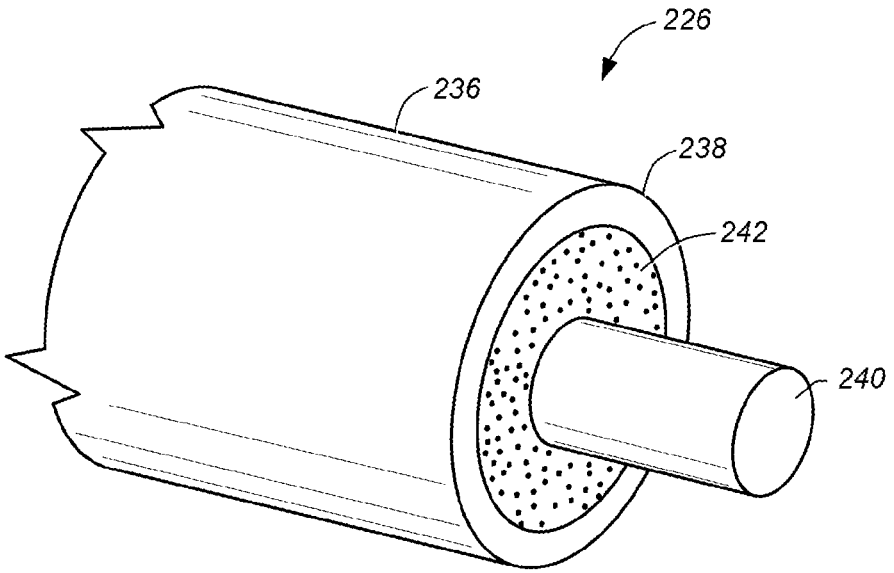
FIG. 3 depicts a perspective view of an end portion of an embodiment of a heater.

Heater 226 may be a temperature limited heater. Temperature limited heaters are described, for example, in U.S. Pat. No. 8,200,072 to Vinegar et al.; U.S. Pat. No. 8,224,164 to Sandberg et al.; U.S. Pat. No. 8,238,730 to Sandberg et al.; and U.S. Pat. No. 8,355,623 to Vinegar et al., all of which are incorporated herein by reference. FIG. 3 depicts a perspective view of an end portion of an embodiment of heater 226. Heater 226 may include insulated conductor 236. Insulated conductor 236 may have any desired cross-sectional shape such as, but not limited to, round (depicted in FIGS. 2 and 3), triangular, ellipsoidal, rectangular, hexagonal, or irregular. In certain embodiments, insulated conductor 236 includes jacket 238, core 240, and electrical insulator 242. Core 240 may resistively heat when an electrical current passes through the core. Alternating or time-varying current and/or direct current may be used to provide power to core 240 such that the core resistively heats.

In some embodiments, electrical insulator 242 inhibits current leakage and arcing to jacket 238. Electrical insulator 242 may thermally conduct heat generated in core 240 to jacket 238. Jacket 238 may radiate or conduct heat to the formation and to the fluid passing through the canister. In certain embodiments, insulated conductor 236 is 1000 m or more in length. Longer or shorter insulated conductors may also be used to meet specific application needs. The dimensions of core 240, electrical insulator 242, and jacket 238 of insulated conductor 236 may be selected such that the insulated conductor has enough strength to be self-supporting even at upper working temperature limits. Such insulated conductors may be suspended from wellheads or supports positioned near an interface between an overburden and a hydrocarbon containing formation without the need for support members extending into the hydrocarbon containing formation along with the insulated conductors.

Insulated conductor 236 may be designed to operate at power levels of up to about 1650 watts/meter or higher. In certain embodiments, insulated conductor 236 operates at a power level between about 500 watts/meter and about 1150 watts/meter when heating a formation. Insulated conductor 236 may be designed so that a maximum voltage level at a typical operating temperature does not cause substantial thermal and/or electrical breakdown of electrical insulator 242. Insulated conductor 236 may be designed such that jacket 238 does not exceed a temperature that will result in a significant reduction in corrosion resistance properties of the jacket material. In certain embodiments, insulated conductor 236 may be designed to reach temperatures within a range between about 650° C. and about 900° C. Insulated conductors having other operating ranges may be formed to meet specific operational requirements.

FIG. 3 depicts insulated conductor 236 having a single core 240 (heating elements). As shown in FIG. 2, insulated conductor 236 has three cores 240. In other embodiments, a single insulated conductor may have two or more cores (heating elements). Core 240 may be made of metal or another electrically conductive material. The material used to form core 240 may include, but not be limited to, nichrome, copper, nickel, carbon steel, stainless steel, and combinations thereof. In certain embodiments, core 240 is chosen to have a diameter and a resistivity at operating temperatures such that its resistance, as derived from Ohm's law, makes it electrically and structurally stable for the chosen power dissipation per meter, the length of the heater, and/or the maximum voltage allowed for the core material.

In some embodiments, core 240 is made of different materials along a length of insulated conductor 236. For example, a first section of core 240 may be made of a material that has a significantly lower resistance than a second section of the core. The first section may be placed adjacent to a formation layer that does not need to be heated to as high a temperature as a second formation layer that is adjacent to the second section. The resistivity of various sections of core 240 may be adjusted by having a variable diameter and/or by having core sections made of different materials.

Electrical insulator 242 may be made of a variety of materials. Commonly used powders may include, but are not limited to, MgO, $Al_2O_3$, Zirconia, BeO, different chemical variations of Spinels, and combinations thereof. MgO may provide good thermal conductivity and electrical insulation properties. The desired electrical insulation properties include low leakage current and high dielectric strength. A low leakage current decreases the possibility of thermal breakdown and the high dielectric strength decreases the possibility of arcing across the insulator. Thermal breakdown can occur if the leakage current causes a progressive rise in the temperature of the insulator leading to arcing across the insulator.

Jacket 238 may be an outer metallic layer or electrically conductive layer. Jacket 238 may be in contact with hot formation fluids. Jacket 238 may be made of material having a high resistance to corrosion at elevated temperatures. Alloys that may be used in a desired operating temperature range of jacket 238 include, but are not limited to, 304 stainless steel, 310 stainless steel, Incoloy® 800, and Inconel® 600 (Inco Alloys International, Huntington, W. Va., U.S.A.). The thickness of jacket 238 may have to be sufficient to last for three to ten years in a hot and corrosive environment. A thickness of jacket 238 may generally vary between about 1 mm and about 2.5 mm. For example, a 1.3 mm thick, 310 stainless steel outer layer may be used as jacket 238 to provide good chemical resistance to sulfidation corrosion in a heated zone of a formation for a period of over 3 years. Larger or smaller jacket thicknesses may be used to meet specific application requirements. In some embodiments, jacket 238 is not used to conduct electrical current.

One or more insulated conductors may be placed within a canister in an opening in a formation to form a heat source or heat sources. Electrical current may be passed through each insulated conductor in the opening to heat the formation. Alternately, electrical current may be passed through selected insulated conductors in an opening. The unused conductors may be used as backup heaters. Insulated conductors may be electrically coupled to a power source in any convenient manner. Each end of an insulated conductor may be coupled to lead-in cables that pass through a wellhead. Such a configuration typically has a 180° bend (a "hairpin" bend) or turn located near a bottom of the heat source. An insulated conductor that includes a 180° bend or turn may not require a bottom termination, but the 180° bend or turn may be an electrical and/or structural weakness in the heater. Insulated conductors may be electrically coupled together in series, in parallel, or in series and parallel combinations. In some embodiments of heat sources, electrical current may pass into the conductor of an insulated conductor and may be returned through the jacket of the insulated conductor by connecting core 240 to jacket 238 at the bottom of the heat source.

Temperature limited heaters may be in configurations and/or may include materials that provide automatic temperature limiting properties for the heater at certain temperatures. In certain embodiments, ferromagnetic materials are used in temperature limited heaters. Ferromagnetic material may self-limit temperature at or near the Curie temperature of the material and/or the phase transformation temperature range to provide a reduced amount of heat when a time-varying current is applied to the material. In certain embodiments, the ferromagnetic material self-limits temperature of the temperature limited heater at a selected temperature that is approximately the Curie temperature and/or in the phase transformation temperature range. In certain embodiments, the selected temperature is within about 35° C., within about 25° C., within about 20° C., or within about 10° C. of the Curie temperature and/or the phase transformation temperature range. In certain embodiments, ferromagnetic materials are coupled with other materials (for example, highly conductive materials, high strength materials, corrosion resistant materials, or combinations thereof) to provide various electrical and/or mechanical properties. Some parts of the temperature limited heater may have a lower resistance (caused by different geometries and/or by using different ferromagnetic and/or non-ferromagnetic materials) than other parts of the temperature limited heater. Having parts of the temperature limited heater with various materials and/or dimensions allows for tailoring the desired heat output from each part of the heater.

Temperature limited heaters may be more reliable than other heaters. Temperature limited heaters may be less apt to break down or fail due to hot spots in the formation. In some embodiments, temperature limited heaters allow for substantially uniform heating of the formation. In some embodiments, temperature limited heaters are able to heat the formation more efficiently by operating at a higher average heat output along the entire length of the heater. The temperature limited heater operates at the higher average heat output along the entire length of the heater because power to the heater does not have to be reduced to the entire heater, as is the case with typical constant wattage heaters, if a temperature along any point of the heater exceeds, or is about to exceed, a maximum operating temperature of the heater. Heat output from portions of a temperature limited heater approaching a Curie temperature and/or the phase transformation temperature range of the heater automatically reduces without controlled adjustment of the time-varying current applied to the heater. The heat output automatically reduces due to changes in electrical properties (for example, electrical resistance) of portions of the temperature limited heater. Thus, more power is supplied by the temperature limited heater during a greater portion of a heating process.

In certain embodiments, the system including temperature limited heaters initially provides a first heat output and then provides a reduced (second heat output) heat output, near, at, or above the Curie temperature and/or the phase transformation temperature range of an electrically resistive portion of the heater when the temperature limited heater is energized by a time-varying current. The first heat output is the heat output at temperatures below which the temperature limited heater begins to self-limit. In some embodiments, the first heat output is the heat output at a temperature of about 50° C., about 75° C., about 100° C., or about 125° C. below the Curie temperature and/or the phase transformation temperature range of the ferromagnetic material in the temperature limited heater.

The temperature limited heater may be energized by time-varying current (alternating current or modulated direct current) supplied at the wellhead. The wellhead may include a power source and other components (for example, modulation components, transformers, and/or capacitors) used in supplying power to the temperature limited heater. The temperature limited heater may be one of many heaters used to heat a portion of the formation.

In some embodiments, a relatively thin conductive layer is used to provide the majority of the electrically resistive heat output of the temperature limited heater at temperatures up to a temperature at or near the Curie temperature and/or the phase transformation temperature range of the ferromagnetic conductor. Such a temperature limited heater may be used as the heating member in an insulated conductor heater. The heating member of the insulated conductor heater may be located inside a sheath with an insulation layer between the sheath and the heating member.

Temperature limited heaters may be utilized for heavy oil applications (for example, treatment of relatively permeable formations or tar sands formations). A temperature limited heater may provide a relatively low Curie temperature and/or phase transformation temperature range so that a maximum average operating temperature of the heater is less than 350° C., 300° C., 250° C., 225° C., 200° C., or 150° C. In a tar sands formation, a maximum temperature of the temperature limited heater may be less than about 250° C. to inhibit olefin generation and production of other cracked products. In some embodiments, a maximum temperature of the temperature limited heater is above about 250° C. to produce lighter hydrocarbon products. In some embodiments, the maximum temperature of the heater may be at or less than about 500° C.

Figure 4:
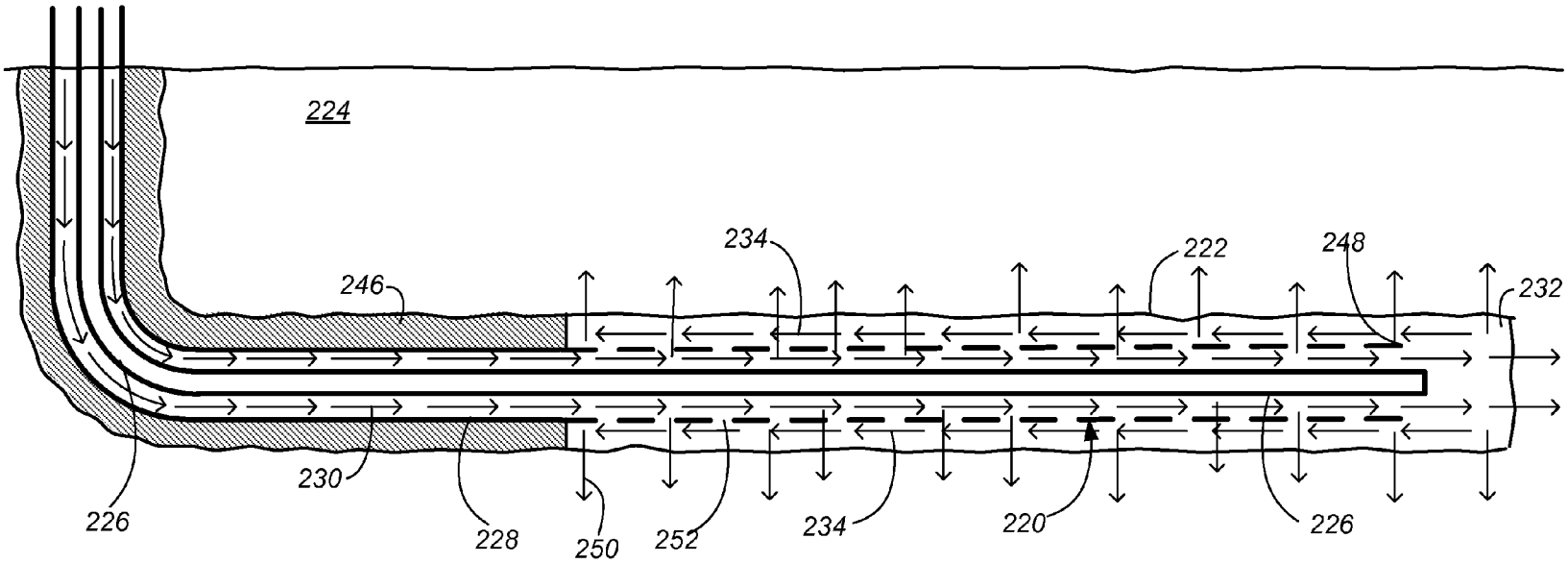
FIG. 4 depicts a perspective view of an embodiment of a fluid injection heater in an opening in a hydrocarbon layer.
Figure 5:
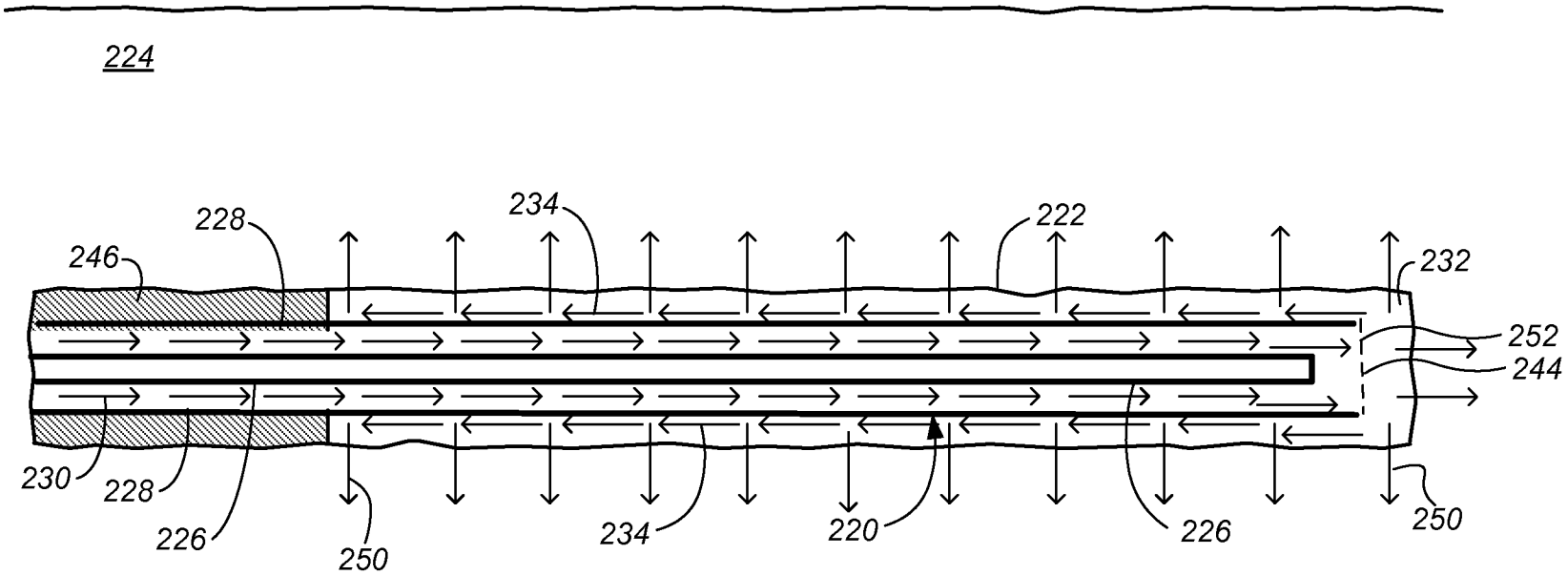
FIG. 5 depicts an embodiment of a fluid injection heater with an end member.

FIGS. 4 and 5 depict perspective views of embodiments of fluid injection heater 220 in substantially horizontal or inclined openings in hydrocarbon layer 224. FIG. 4 depicts a perspective view of an embodiment of fluid injection heater 220 in opening 232 in hydrocarbon layer 224. FIG. 5 depicts an embodiment of a fluid injection heater with end member 244.

Fluid injection heater 220 includes heater 226 positioned inside canister 228. Hydrocarbon layer 224 may include fractures, and vugs. In some embodiments, fluid injection heater 220 may be positioned near or in the fractures. In certain embodiments, opening 232 may be a substantially horizontal or inclined opening within hydrocarbon layer 224. In some embodiments, opening 232 may be wellbore 222 formed in hydrocarbon layer 224 using known drilling techniques.

In some embodiments, opening 232 may include packing 246. Packing 246 may inhibit fluid from flowing into opening 232 at locations within the opening. A length of packing 246 within opening 232 may be adjusted to vary the length at which fluid is injected into the formation. For example, adjusting lengthening packing 246 decreases the amount of steam returned in opening 232, and increases the amount of steam exiting end 248 of fluid injection heater 220.

Steam may be injected through canister 228 (as shown by arrows 230) into opening 232 of hydrocarbon layer 224. Steam may flow along the length of heater 226 and into opening 232. A portion of the steam, due to some pressure in opening 232, may change direction and flow in the annulus formed between canister 228 and side of the opening (as shown by arrows 234), and into hydrocarbon formation (as shown by arrows 250). As shown, canister 228 includes perforations 252, which allows fluid (steam) to enter opening 232 and then flow into hydrocarbon layer 224 (as shown by arrows 250).

In some embodiments, as shown in FIG. 5, canister 228 includes an end member 244 (for example, a cap or cover). End member 244 may be coupled or directly connected to canister 228. End member 244 may direct steam into the annulus between the canister 228 and opening 232. Injected steam may flow through canister 228 as shown by arrows 230, contact end member 244, change direction (for example, reverse flow) and flow in the annulus between the canister and the opening 232, and into the hydrocarbon formation. End member 244 includes perforations 252 that allow steam to flow out the end of the canister and into the formation. As shown in FIG. 5, canister 228 does not include perforations, however, perforations in the canister may be present.

In some embodiments, perforations 252 in canister 228 may include covers that open or close as needed to control injection of fluid into opening 232 along the length of fluid injection heater 220. For example, sliding sleeves may cover perforations 252 in canister 228. The sliding sleeves may be opened or closed along the length of fluid injection heater using one or more controllers.

Prior to, or during steam injection, electrical current may be applied to heater 226 to generate radiant and/or convective heat. Heat from heater 226 heats the steam and the opening 232. Using heat from the heater 226 inhibits cooling of the fluid (steam) as it flows along the length of opening 232. Thus, the formation is heated at a faster rate using conductive and convective heat as compared to a steam and/or heater process.

In some embodiments, after a period of time, electrical current applied to heater elements 240 (shown in FIGS. 2 and 3) of heater 226 may be adjusted depending on the temperature in the opening, or turned off. In some embodiments, after a period of time, steam injection is discontinued and heat is supplied using heater 226. For example, when production of hydrocarbons mobilized from heat generated by fluid injection heaters starts, fluid (steam) injection may be stopped and the power reduced. The ability to apply heat to the fluid as it flows along the length of heater 226 provides more efficient heating of the hydrocarbon layer.

It has unexpectedly been found that the use of fluid injection heaters increases a rate of formation heating as compared to using steam injection alone, heaters alone, the use of heating a formation with heaters and then applying steam or vice versa, or a hybrid steam heating process. A hybrid steam heating process may include injecting steam in a wellbore that includes a heater, but does not include a canister surrounding the heater system. The use of fluid injection heaters may also lower a heating temperature while increasing the amount of heat provided to the formation. The use of fluid injection heaters provides conductive heat, radiant heat, and/or convective heat to the formation. Heating a hydrocarbon layer with a fluid injection heater provides more heat to the layer, and, thus oil may be produced from the formation at a faster rate. Furthermore, the flow of fluid along the outside jacket (tubular) of the heater inhibits "hot spots" from forming on the heater. Thus, heater life is extended.

In conventional steam injection with heaters (for example, a hybrid steam injection process), hot spots on the heater may be caused by steam escaping into fractures in the hydrocarbon layer and not flowing along the length of the heater. Use of a canister to direct the flow of the fluid into the formation reduces or eliminates hot spots on the heater. In some embodiments, the heater (either the temperature limited heater or another type of non-temperature limited heater) has sections that are lower because of sagging over long heater distances. These lower sections may sit in heavy oil or bitumen that collects in lower portions of the wellbore. At these lower sections, the heater may develop hot spots due to coking of the heavy oil or bitumen. A standard non-temperature limited heater may overheat at these hot spots, thus producing a non-uniform amount of heat along the length of the heater. Using steam injected into a canister that surrounds the heater may inhibit overheating of the heater at hot spots, or downstream sections, and provide more uniform heating along the length of the wellbore.

Figure 6:
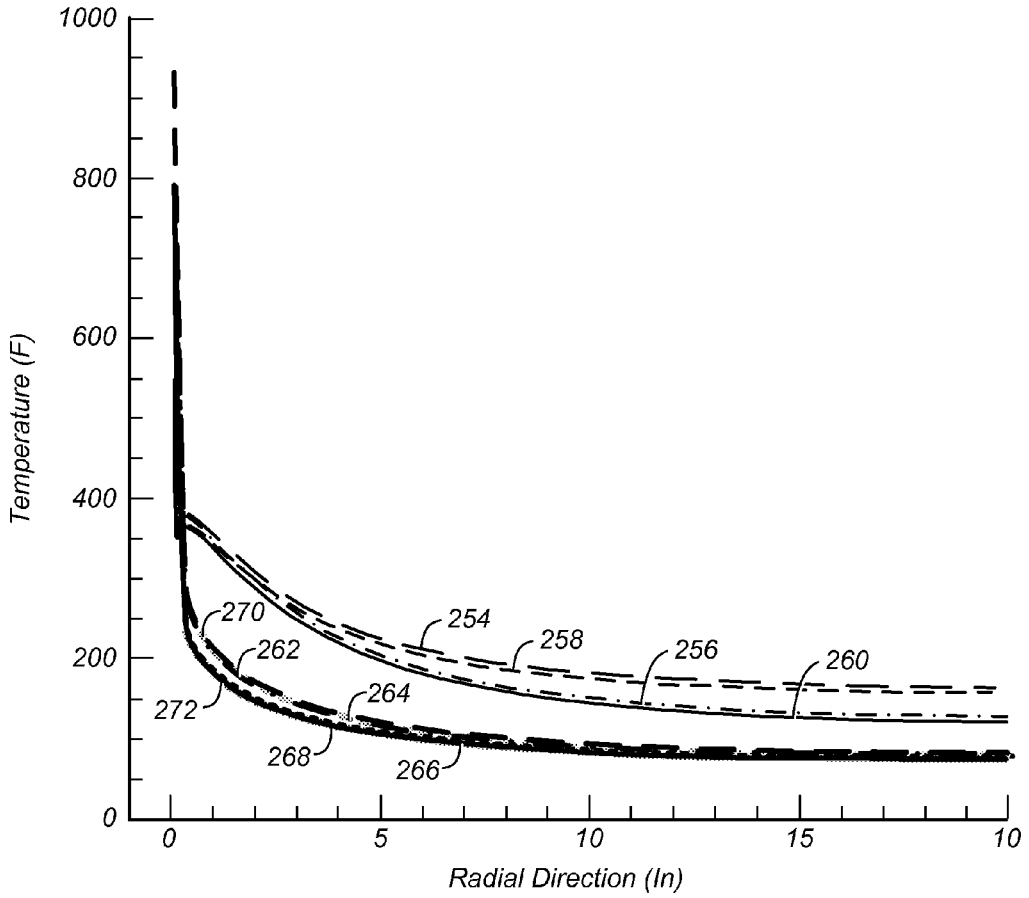
FIG. 6 is a graphical representation of temperature profiles (degrees Fahrenheit) at the mid-point of heater along radial direction (inches) of heating a hydrocarbon formation.

Use of a steam injection heater allows the heater element to be operated at higher power output for a longer period of time as compared to conventional temperature limited heaters. FIG. 6 is a graphical representation of temperature profiles (degrees Fahrenheit) at the mid-point of heater along radial direction (inches) of heating a hydrocarbon formation using a steam injection heater and the electrical heating element of the steam injection heater. Data 254 through 272 represent the effect of heating a formation using temperature limited heaters and steam injection heaters operated at various power levels for various amounts of time. TABLE 1 lists the type of heater, power wattage, and time period of heating.

TABLE 1

| Data No. | Type of Heating | Power (watts) | Time period (weeks) |
|---|---|---|---|
| 254 | Steam Injection Heater | 500 | 8 |
| 256 | Steam Injection Heater | 500 | 4 |
| 258 | Steam Injection Heater | 350 | 8 |
| 260 | Steam Injection Heater | 350 | 4 |
| 262 | Electrical Heater only | 500 | 8 |
| 264 | Electrical Heater only | 500 | 4 |
| 266 | Electrical Heater only | 350 | 8 |
| 268 | Electrical Heater only | 350 | 4 |
| 270 | Electrical Heater only | 500 | 52 |
| 272 | Electrical Heater only | 35 | 52 |

From the data in FIG. 6, it may be concluded that a hydrocarbon formation is heated to a higher temperature using a steam injection heater as compared to heating the formation with an electrical heater. It may also be concluded that the hydrocarbon formation is heated to a higher temperature using less power supplied to the electrical element of the heater. Thus, a fluid injection heater is more efficient than an electrical heating element.

Figure 7:
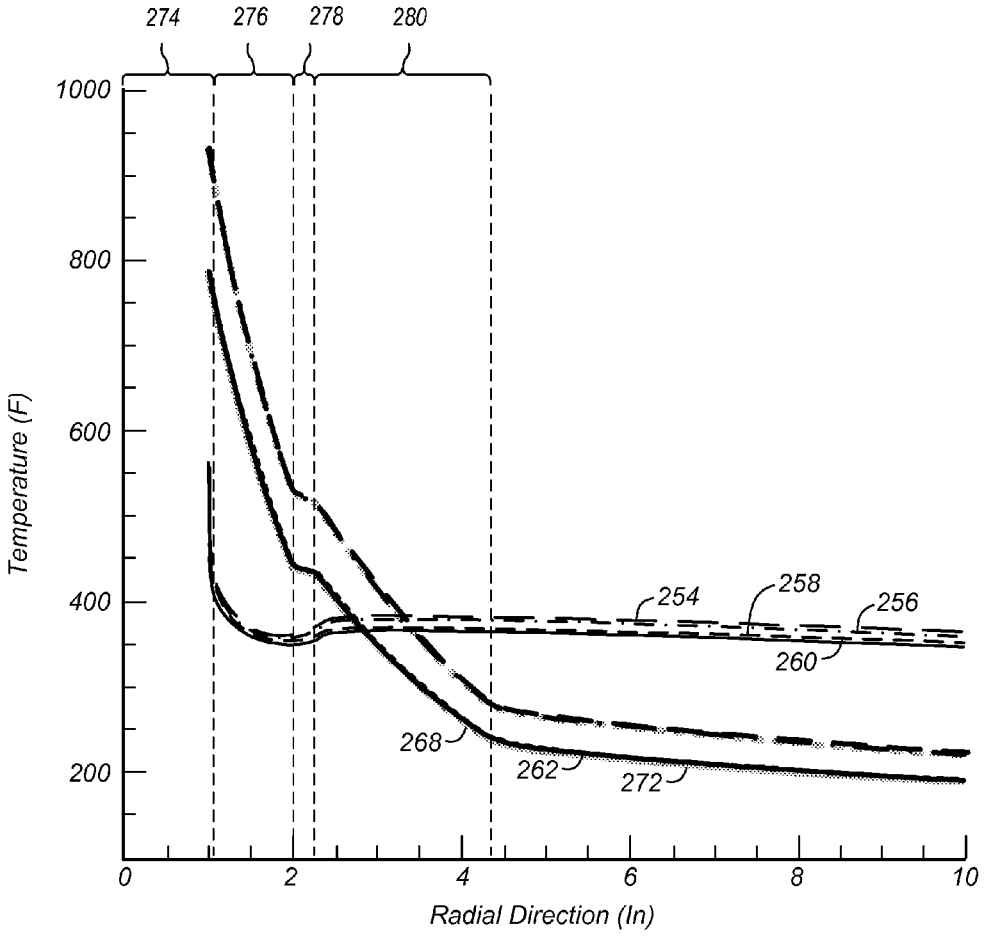
FIG. 7 depicts an expanded portion of the graph depicted in FIG. 7.

FIG. 7 depicts an expanded portion of the graph depicted in FIG. 6. Section 274 represents the temperature profile of outer diameter of the jacket, section 276 represents the temperature profile along the canister inner diameter, section 278 represents the temperature profile of the sand surface, and section 280 represents the temperature profile of the canister outer diameter. As shown the heater jacket surface temperature in section 274 is lower when steam is injected into canister as compared to the heater jacket temperature in section 274 without steam injection. For example, a heater element in a steam injection heater is about 200° F. (93° C.) to 300° F. (148° C.) as compared to the heater element alone. Thus, a steam-injection heater leads to lower heater-sheath surface temperatures, which reduces the risk of "hot spot" developments. From the data in FIGS. 6 and 7, it is demonstrated that a steam injection heater provides a higher electrical energy injection rate.

Use of a fluid injection heater may inhibit channeling or fingering of fluid, which reduces the effectiveness of introduced pressurized fluid. Any energy added to the formation during the heated fluid injection process reduces the amount of energy and/or time needed to be supplied by heaters for the in situ heat treatment process. The flow of steam around the heater may allow the heater to be used at a higher wattage, with less energy expended to heat the formation. Reducing the amount of total energy to heat up the hydrocarbon layer using a fluid injection heater reduces costs for treating the formation. For example, a hydrocarbon formation may be heated using a steam injection heater to about 150° F. for 65 days, steam is injected through the canister and the formation is heated using conductive and radiant heat. After 800 days the hydrocarbon formation has reached a temperature of about has been heated to 475° F. (246° C.). In comparison, using the same type of electrical heater, the hydrocarbon formation may be heated to about 150° F. for 65 days and after 800 days a temperature of the hydrocarbon formation is about 270° F. (132° C.).

Figure 8:
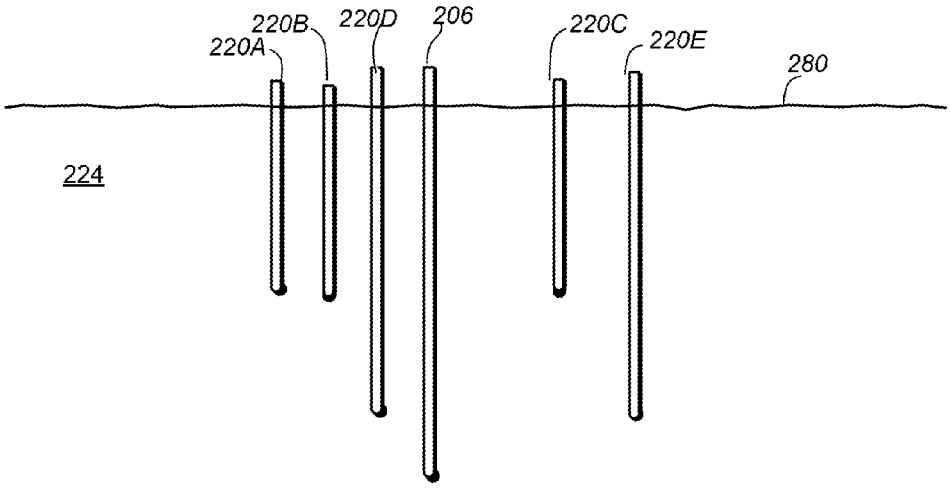
FIG. 8 depicts a side view representation of an embodiment of treating a hydrocarbon using a fluid injection heater process.
Figure 9:
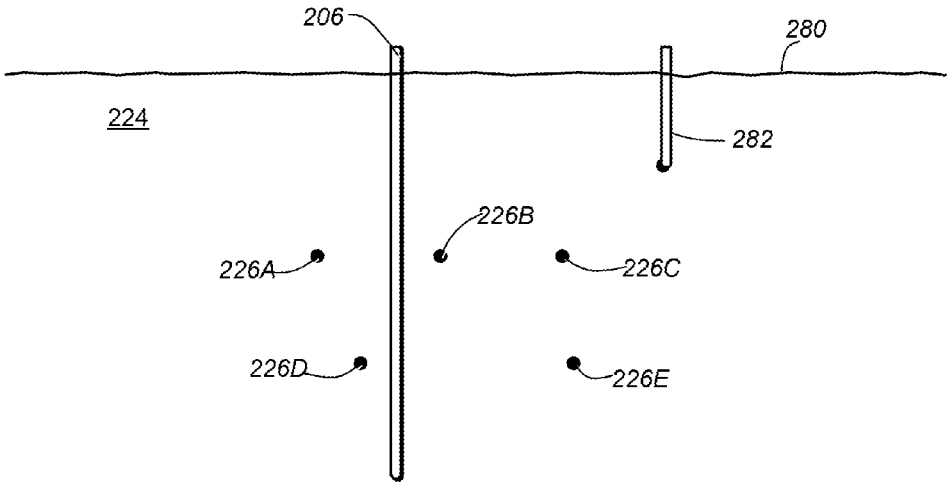
FIG. 9 depicts a side view representation of a conventional steam injection in combination with heaters heating process.
Figure 10:
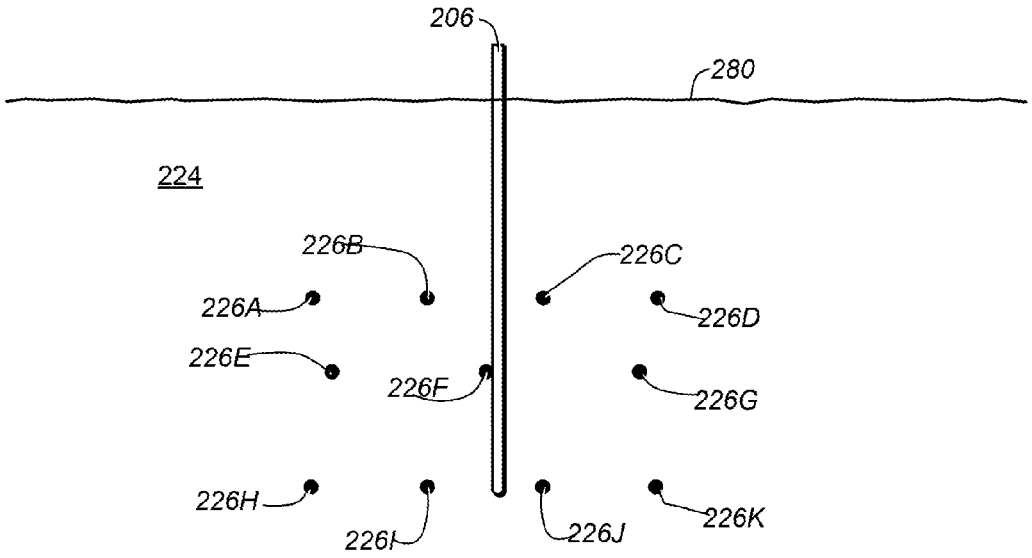
FIG. 10 depicts a side view of a conventional in situ heat treatment process using electrical heaters.

Using a fluid injection heater, less heaters (for example, 5 steam injection heaters) may be utilized to heat an area of hydrocarbon layer as compared to the amount of heaters and injectors (for example, 5 heaters and 1 injection well) used to heat the same hydrocarbon layer area using a conventional steam injection and heater process, or electrical heaters (11 electrical heaters) used to heat the same hydrocarbon layer are using a conventional in situ thermal process. FIGS. 8-10 depict side view representations of embodiments of treating a hydrocarbon formation using a fluid injection heater process, steam injection in combination with heaters process, and electrical heater process. FIG. 8 depicts a side view representation of an embodiment of treating a hydrocarbon using a fluid injection heater process. Fluid injection heaters 220A-220E may be located in hydrocarbon layer 224. Hydrocarbon containing layer 224 may be below overburden 280. Electrical current may be applied to the electrical elements of fluid injection heaters 220A-220C. In some embodiments, fluid injection heaters 220A-220C are located in a different hydrocarbon layer than fluid injection heaters 220D and 220E. Fluid (for example, steam) may be injected at pressure of about 4.8 MPa (about 700 psi) through fluid injection heater 220A-220E after the formation has been heated for a period of time with just radiant heat from heating elements of the fluid injection heater. In some embodiments, fluid may be injected at the beginning of the heating. Sufficient conductive and radiant heat from the fluid and the heating elements may be transferred to hydrocarbon layer 224 to reduce the viscosity of hydrocarbons in the layer and mobilize the hydrocarbons. Mobilized hydrocarbons are produce from production well 206.

In contrast to heating with fluid injection heaters, FIG. 9 depicts a side view representation of a conventional steam injection in combination with heaters process. Heaters 226A-226E heat hydrocarbon layer 224 for a period of time to increase the permeability of the layer. Steam is injected through injection wellbore 282 to mobilize the hydrocarbons towards production well 206. FIG. 10 depicts a side view of a conventional in situ heat treatment process using electrical heaters (for example, temperature limited heaters). Heaters 226A-226K heat hydrocarbon layer 224 to mobilize hydrocarbons in hydrocarbon layer 224. Mobilized hydrocarbons are produced at production well 206.

Using a fluid injection heater, more hydrocarbons may be produced per day as compared to a conventional steam and heater heating. For example, hydrocarbons may be produced from a hydrocarbon formation at a rate of 10 to 15 BBL/day after being heated for 2 years using a fluid injection heater. In contrast, hydrocarbons may be produced at a rate of about 1 BBL/day after 2 years using a conventional steam and heater heating process, and less than about 1 BBL/day after 2 years using a conventional heater heating process.

Heat fluid injection heater may heat hydrocarbons in the hydrocarbon layer 224 to reduce the viscosity of hydrocarbons to mobilize the hydrocarbons toward one or more production wells located in the hydrocarbon formation. In some embodiments, reducing the viscosity of hydrocarbons allows or enhances production of heavy hydrocarbons (at most about 10° API gravity oil) or intermediate gravity hydrocarbons (approximately 12° to 20° API gravity oil) from the formation. In certain embodiments, the initial API gravity of hydrocarbons in the formation is at most 10°, at most 20°, at most 25°, or at most 30°. In certain embodiments, the viscosity of hydrocarbons in the formation is at least 0.05 Pa·s (50 cp). In some embodiments, the viscosity of hydrocarbons in the formation is at least 0.10 Pa·s (100 cp), at least 0.15 Pa·s (150 cp), or at least at least 0.20 Pa·s (200 cp).

In certain embodiments, in situ treatment of the relatively permeable formation containing hydrocarbons (for example, the tar sands formation) using a fluid injection heater includes heating the formation to visbreaking temperatures. For example, the fluid injection heater process may heat the formation to an average temperature between about 100° C. and 260° C., between about 150° C. and about 250° C., between about 200° C. and about 240° C., between about 205° C. and about 230° C., or between about 210° C. and about 225° C. In one embodiment, the formation is heated to a temperature of about 220° C. In one embodiment, the formation is heated to a temperature of about 230° C.

At visbreaking temperatures, fluids in the formation have a reduced viscosity (versus their initial viscosity at initial formation temperature) that allows fluids to flow in the formation. The reduced viscosity at visbreaking temperatures may be a permanent reduction in viscosity as the hydrocarbons go through a step change in viscosity at visbreaking temperatures versus heating to mobilization temperatures, which may only temporarily reduce the viscosity. In some embodiments, heating is conducted such that an average viscosity of formation fluids in a hot fluid injection section and a section heated by heaters are within about 20% of each other. The visbroken fluids may have API gravities that are relatively low (for example, at most about 10°, about 12°, about 15°, or about 19° API gravity), but the API gravities are higher than the API gravity of non-visbroken fluid from the formation. The non-visbroken fluid from the formation may have an API gravity of 7° or less.

In certain embodiments, treating the formation includes maintaining the temperature at or near visbreaking temperatures (as described above) during the entire production phase while maintaining the pressure below the fracture pressure. The heat provided to the formation may be reduced or eliminated to maintain the temperature at or near visbreaking temperatures. Heating to visbreaking temperatures but maintaining the temperature below pyrolysis temperatures or near pyrolysis temperatures (for example, below about 230° C.) inhibits coke formation and/or higher level reactions. Heating to visbreaking temperatures at higher pressures (for example, pressures near but below the fracture pressure) keeps produced gases in the liquid oil (hydrocarbons) in the formation and increases hydrogen reduction in the formation with higher hydrogen partial pressures. Heating the formation to only visbreaking temperatures also uses less energy input than heating the formation to pyrolysis temperatures.

In some embodiments, after the formation reaches visbreaking temperatures, the pressure in the formation is reduced. In certain embodiments, the pressure in the formation is reduced at temperatures above visbreaking temperatures. Reducing the pressure at higher temperatures allows more of the hydrocarbons in the formation to be converted to higher quality hydrocarbons by visbreaking and/or pyrolysis. Allowing the formation to reach higher temperatures before pressure reduction, however, may increase the amount of carbon dioxide produced and/or the amount of coking in the formation. For example, in some formations, coking of bitumen (at pressures above 700 kPa) begins at about 280° C. and reaches a maximum rate at about 340° C. At pressures below about 700 kPa, the coking rate in the formation is minimal. Allowing the formation to reach higher temperatures before pressure reduction may decrease the amount of hydrocarbons produced from the formation.

In certain embodiments, the temperature in the formation (for example, an average temperature of the formation) when the pressure in the formation is reduced is selected to balance one or more factors. The factors considered may include: the quality of hydrocarbons produced, the amount of hydrocarbons produced, the amount of carbon dioxide produced, the amount hydrogen sulfide produced, the degree of coking in the formation, and/or the amount of water produced. Experimental assessments using formation samples and/or simulated assessments based on the formation properties may be used to assess results of treating the formation using the in situ heat treatment process. These results may be used to determine a selected temperature, or temperature range, for when the pressure in the formation is to be reduced. The selected temperature, or temperature range, may also be affected by factors such as, but not limited to, hydrocarbon or oil market conditions and other economic factors. In certain embodiments, the selected temperature is in a range between about 275° C. and about 305° C., between about 280° C. and about 300° C., or between about 285° C. and about 295° C.

In certain embodiments, fluids are produced from the formation to maintain a pressure in the formation below a selected pressure as the temperature of the formation increases. In some embodiments, the selected pressure is a fracture pressure of the formation. In certain embodiments, the selected pressure is between about 1,000 kPa and about 15,000 kPa, between about 2,000 kPa and about 10,000 kPa, or between about 2,500 kPa and about 5,000 kPa. In one embodiment, the selected pressure is about 10,000 kPa. Maintaining the pressure as close to the fracture pressure as possible may minimize the number of production wells needed for producing fluids from the formation. In some embodiments, heating is conducted such that an average pressure in a hot fluid injection section and a section heated by heaters are within about 20% of each other.

In certain embodiments, the amount of fluids produced at temperatures below visbreaking temperatures, the amount of fluids produced at visbreaking temperatures, the amount of fluids produced before reducing the pressure in the formation, and/or the amount of upgraded or pyrolyzed fluids produced may be varied to control the quality and amount of fluids produced from the formation and the total recovery of hydrocarbons from the formation. For example, producing fluids (for example, bitumen) from the bottom of the formation may increase the total recovery of hydrocarbons from the formation while reducing the overall quality (lowering the overall API gravity) of fluid produced from the formation. The overall quality is reduced because more heavy hydrocarbons are produced by producing more fluids at the lower temperatures. Producing less fluids at the lower temperatures may increase the overall quality of the fluids produced from the formation but may lower the total recovery of hydrocarbons from the formation. The total recovery may be lower because more coking occurs in the formation when fewer fluids are produced at lower temperatures.

In some embodiments, the heated fluid is heated to a temperature using heat from the fluid injection heaters such that an in situ drive fluid is created or produced in the hydrocarbon layer or other portions of the formation. The in situ produced drive fluid may move through the formation and move mobilized hydrocarbons from one portion of the formation to another portion of the formation.

The hydrocarbon formation may include formation fluid (for example, hydrocarbons) having an initial viscosity of at least about 1 Pa·s (1,000 cp), at least about 5 Pa·s (5,000 cp) or at least 10 Pa·s (10,000 cp) at 15° C. The initial viscosity may vary depending on the location or depth of the fluid in the formation. Heat from the heat fluid and heaters may reduce the viscosity of hydrocarbons such that the hydrocarbons gravity drain to a bottom portion of the hydrocarbon formation. In some embodiments, the hydrocarbons drain through the fractures in the formation to a bottom portion of the hydrocarbon layer. In certain embodiments, the hydrocarbon layer in the formation has sufficient permeability to allow mobilized and/or visbroken fluids to drain to the bottom of the formation. For example, the hydrocarbon layer in the formation may have a permeability of at least about 0.1 darcy, at least about 1 darcy, at least about 10 darcy, or at least about 100 darcy. In some embodiments, the hydrocarbon layer has a relatively large vertical permeability to horizontal permeability ratio ($K_v/K_h$). For example, a hydrocarbon layer may have a $K_v/K_h$ ratio between about 0.01 and about 2, between about 0.1 and about 1, or between about 0.3 and about 0.7. The mobilized and/or visbroken hydrocarbons may be produced using a production well positioned in the bottom portion of the formation.

The produced mixture may have assessable properties (for example, measurable properties). The produced mixture properties are determined by operating conditions in the formation being treated (for example, temperature and/or pressure in the formation). In certain embodiments, the operating conditions may be selected, varied, and/or maintained to produce desirable properties in hydrocarbons in the produced mixture. For example, the produced mixture may include hydrocarbons that have properties that allow the mixture to be easily transported (for example, sent through a pipeline without adding diluent or blending the mixture and/or resulting hydrocarbons with another fluid).

It is to be understood the invention is not limited to particular systems described which may, of course, vary. It is also to be understood that the terminology used herein is for the purpose of describing particular embodiments only, and is not intended to be limiting. As used in this specification, the singular forms "a", "an" and "the" include plural referents unless the content clearly indicates otherwise. Thus, for example, reference to "a core" includes a combination of two or more cores and reference to "a material" includes mixtures of materials.

In this patent, certain U.S. patents and U.S. patent applications have been incorporated by reference. The text of such U.S. patents and U.S. patent applications is, however, only incorporated by reference to the extent that no conflict exists between such text and the other statements and drawings set forth herein. In the event of such conflict, then any such conflicting text in such incorporated by reference U.S. patents and U.S. patent applications is specifically not incorporated by reference in this patent.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A method for treating a subsurface hydrocarbon formation, comprising:

applying electrical current to one or more heating elements positioned in a first tubular located in an opening in the subsurface hydrocarbon formation, wherein the first tubular is positioned inside a second tubular positioned in the opening in the subsurface hydrocarbon formation;

providing fluid through the second tubular such that a portion of the fluid flows between the first tubular and second tubular in a first direction along a length of the tubulars;

allowing at least some of the fluid to flow through an annulus between the second tubular and walls of the opening in a second direction, the second direction being opposite to the first direction;

allowing at least some of the fluid to flow into a hydrocarbon layer in the subsurface hydrocarbon formation from the annulus between the second tubular and the walls of the opening and from an end of the second tubular distal from a surface of the formation; and allowing heat to transfer from the fluid and at least one of the heating elements to a portion of the hydrocarbon layer in the subsurface hydrocarbon formation.

2. The method of claim 1, further comprising mobilizing hydrocarbons in the hydrocarbon layer.

3. The method of claim 1, further comprising producing hydrocarbons from another portion of the subsurface hydrocarbon formation.

4. The method of claim 1, wherein at least a portion of the first and second tubulars are substantially horizontal or inclined in the hydrocarbon layer.

5. The method of claim 1, wherein the transferred heat pyrolyzes at least some hydrocarbons in the hydrocarbon layer.

6. The method of claim 1, wherein the transferred heat pyrolyzes at least some hydrocarbons in the hydrocarbon layer, and producing at least some of the pyrolyzed hydrocarbons from the layer through a production well extending into the hydrocarbon layer.

7. The method of claim 1, wherein the fluid is steam.

8. The method of claim 1, wherein the providing fluid allows at least one of the heating elements to be operated at a higher power level as compared to operating the heating element in the absence of fluid.

9. The method of claim 1, wherein providing fluid allows substantially uniform heating along the length of at least one of the heating elements.

10. The method of claim 1, wherein the heat transfer comprises convective heat transfer and radiant heat transfer.

11. The method of claim 1, wherein at least one of the heating elements comprises an electrical conductor.

12. The method of claim 1, wherein providing fluid comprises injecting pressurized fluid into the second tubular, and maintaining a substantially constant average pressure in the second tubular.

13. The method of claim 1, wherein at least some of the fluid flowing in the opening is allowed to change from the first direction to the second direction in the opening.

14. The method of claim 1, wherein at least some of the fluid that flows in the second direction in the annulus comprises fluid that changes direction from the first direction to the second direction when the fluid encounters an end member located at the end of the second tubular distal from the surface of the formation.

15. The method of claim 14, wherein the end member comprises one or more perforations that allow at least some fluid to flow through the end member and into the hydrocarbon layer in the first direction.

* * * * *